US005895544A

United States Patent [19]

Finn et al.

[11] Patent Number: 5,895,544

[45] Date of Patent: Apr. 20, 1999

[54] METHOD OF CONTROLLING DISTANCE BETWEEN MEMBERS DURING ARTICLE MANUFACTURE AND ARTICLE MADE THEREBY

[75] Inventors: Roger C. Finn, Nepean; Raymond K. Orr, Kanata, both of Canada

[73] Assignee: Northern Telecom Limited, Montreal, Canada

[21] Appl. No.: 08/769,567

[22] Filed: Dec. 19, 1996

[51] Int. Cl.[6] ..... H01F 27/26

[52] U.S. Cl. ..... 156/276; 156/304.1; 336/196

[58] Field of Search ..... 156/299, 276, 156/304.1; 336/196

[56] References Cited

U.S. PATENT DOCUMENTS 2,055,175 9/1936 Franz ..... 336/196 X 3,029,403 4/1962 Krueger ..... 156/276 X 4,536,734 8/1985 Mabuchi ..... 336/196

*Primary Examiner*—Francis J. Lorin

*Attorney, Agent, or Firm*—R. J. Austin

[57] ABSTRACT

A method of providing a predetermined set distance apart between two members in article manufacture. This involves clamping the members together with a mixture of an adhesive and glass microspheres between opposing surfaces of the members, the microspheres being of specific grid size. The largest diameter microspheres are gripped between the opposing surfaces thereby determining the distance between the members. The invention is particularly useful for precise location apart between members with small gaps therebetween, e.g. less than 3 mil. It is useful particularly for magnetic device cores of small dimensions.

15 Claims, 2 Drawing Sheets

METHOD OF CONTROLLING DISTANCE BETWEEN MEMBERS DURING ARTICLE MANUFACTURE AND ARTICLE MADE THEREBY

BACKGROUND OF THE INVENTION a) Field of the invention

This invention relates to methods of controlling distance between members during article manufacture and in particular it relates to a method of making magnetic device cores.

b) Discussion of Prior Art

In certain industries where extreme minimal manufacturing tolerances are required, it is sometimes necessary to provide gaps of minimal dimensions, e.g. below 3 mil, with negligible dimensional error. Such small gaps may be required in the manufacture of for instance, magnetic device cores, capacitors or in the optical industry. In the case of magnetic device cores (e.g. as used in transformers and inductors), these comprise two axially aligned core halves formed of a material having a magnetic property, the core halves surrounding a wound magnetic core with each core half providing a radially extending core end at an associated end of the core. In this construction, each core half has at least two axially extending elements which extend from the radial core end of the core half. The first of these elements of the two core halves are axially aligned from one core half to the other and extend towards each other within a passage defined centrally of the wound magnetic coil. The second elements of the two core halves are axially aligned from one core half to the other and extend towards each other in positions outwardly of the wound magnetic coil to provide an axial space of determined size between the second elements. The distance apart of the second elements is determined so as to control the distance apart of the first elements within the wound magnetic coil so as to provide the finished product with required magnetic and electrical characteristics. Normally, the gap between the first elements is controlled by providing a specific axial length to each core half and upon assembly of the core, the core halves are disposed axially together with a non-conductive spacer of known thickness between the second elements of the core halves on the outside of the coil. The core halves are then clamped together with a magnetic coil disposed therein and the spacer with the clamps in position determines the space between the second elements and thus determines the distance between the first elements, i.e. across the gap between their confronting ends within the coil.

Problems exist however with the above conventional method of making the assembly. Spacers disposed between the core halves, which may be of Mylar™ or other materials are particularly difficult to locate and to hold in position between the second elements during the assembly process. Misalignment of spacers may then result. Alternatively, the spacer material may become creased thereby resulting in incorrect spacing apart of the second elements and thus of the first elements with consequent performance deviations in the finished magnetic device core. The misalignment of a spacer between the second elements may be to such a degree that the whole of the spacer is not located between the second elements. In addition, the present manufacturing processes realistically achieve air gaps between the first elements only as low as 1 mil dependent upon the thickness of the spacer material. Further to the use of spacers between the second elements, grinding of one of the ends of the first elements may be a part of the manufacturing process for determination of the air gap. However, when the grinding step is employed, the minimum air gap which may be achieved is of the order of 3 mil.

Clearly therefore with the known methods of assembly of magnetic device cores, the achievement of minimum gaps of 1 mil to 3 mil places a restriction on the minimum producible size a magnetic device core may achieve. It would be in the interest of present technology, for instance, for the use of magnetic device cores upon printed circuit boards, if such cores could be made of a suitable small size. It would also be of interest to be able to provide extremely small gaps of accurately controlled size between elements of a product generally.

SUMMARY OF THE INVENTION

Accordingly, the invention provides a method of constructing an article having two members to be disposed a precise distance apart comprising locating the two members at their desired relative positions with a mixture of an adhesive and substantially non-compressible microspheres of a specific grid size disposed between opposing faces of the two members, and clamping the members together with the adhesive securing the two members together and with the largest microspheres determining the clamped distance apart of the two members.

In general, in use of the above method, the microspheres may be of any suitable non-compressible material depending upon requirements, such as electrical. Glass or some plastics carbon is most suitable for some electrical requirements, but it is envisaged that some metals may be useful for other purposes.

As may be seen with the method according to the invention as defined above, the distance between the two members is dictated solely by the largest microspheres. This means that a specific size of microspheres may be chosen with the knowledge that a percentage of those microspheres having a maximum diameter within the grid size will be gripped between the opposing and no further inward action towards each other of the is then possible. Of course, any microspheres of smaller diameter than this will not be gripped but will remain in position in the adhesive mixture. Hence, the distance apart of the opposing members may be accurately provided by using microspheres of specific maximum diameter. Above all, because a plurality of microspheres having exceedingly small maximum diameters are easily provided, then exceedingly small and accurately controlled gaps may be provided between the first axially extending elements.

The invention also provides a method of making a magnetic device core comprising: providing two core halves each formed of a material having magnetic properties and each having a first axially extending element having a first end for insertion within a wound magnetic coil and having at a second end a radially extending core end, each core half also having a second axially extending element extending from its core end and radially spaced from the first axially extending element; assembling together the core halves and a wound magnetic coil by inserting the first ends of the first axially extending elements into opposite ends of a central passage of the magnetic coil and with the second axially extending elements extending towards each other radially outside and coextensive with the coil; and bringing the core halves axially together and clamping them together with a mixture of an adhesive and non-magnetic, non-compressible, dielectric microspheres of a specific grid size disposed between axially opposing faces of the core halves, the adhesive securing the core halves together with the largest microspheres determining the clamped distance apart of the first ends of the first axially extending elements.

While the method of the invention may be used for the manufacture of magnetic device cores of conventional size, because of the accuracy of determining the distance apart of the first axially extending elements, then smaller magnetic device cores are made possible. With the use of the invention, microspheres may be chosen of smaller maximum diameters than 1 mil which was the smallest dimension possible for an air gap between the first axially extending elements of conventional structures. In fact, with microspheres having a size of 0.5 mil or below, then the distances between the opposing free ends of the first axially extending elements may be determined at substantially 0.5 mil. This result is made possible where each of the core halves is exceptionally small and difficulty may arise in grinding the end surface of the first end of the first axially extending element at a different planar location from that of the second axially extending element. In fact, with such small magnetic device cores, and for achieving predetermined distances between the opposing free ends of the first axially extending elements, it is convenient for each of the core halves to be manufactured with the end surfaces of the first and second axially extending elements both lying on the same plane. While the disadvantageous step of avoiding grinding at different planar positions is achieved, accurate location of the first axially extending elements axially apart is easily obtained.

For use in manufacture of device cores, the microspheres may be made, for instance, of glass or carbon.

In one manner of performing the method of the invention, the core halves each have at least two second axially extending elements which are axially aligned with at least two second axially extending elements of the other core half on assembly. With this particular method, the mixture of adhesive and microspheres may be disposed only between opposing end surfaces of the second axially extending elements thereby forming an empty gap between the first ends of the first elements. Alternatively, the mixture is disposed between these first ends also. In another particular method of the invention, only one second element is provided upon each core half. With this particular method, it is essential to provide the mixture between the first as well as between the second elements to stabilize the core in a rigid structure.

In a further particular method, the second element or at least one of the second elements of each core half provides a first element for insertion within a further wound magnetic core and an amount of mixture of adhesive and microspheres is provided between opposing first ends of axially extending elements as required to provide a rigid core structure. In a yet further particular method, an axially extending series of gaps may be provided between first ends within a wound magnetic coil. This method is used to produce a structure in which the provision of a single large gap could cause a magnetic flux to interfere with flux in the windings of the coil thereby interfering with electrical performance. In this further particular method, a single disc of magnetic core material is disposed between first ends of the first elements or a plurality of discs of magnetic core material are disposed in series between the first ends of the first elements and alternate in their positions axially with amounts of the mixture which space the discs from the first ends of the elements and also from each other.

The invention also includes a magnetic device core comprising: a wound magnetic coil having a central axial passage; two core halves each formed of a material having magnetic properties and each having a first axially extending element extending from a radially extending core end of the associated core half to a first end of the element, and at least one second axially extending element radially outwards from and coextensive with the first axially extending element, the two core halves disposed with the radially extending core ends at opposite axial ends of the coil, the first axially extending elements extending towards each other along the passage to opposing free ends which are spaced apart by a predetermined distance, and a mixture of an adhesive and glass microspheres of a specific grid size disposed between axially opposing faces of the core halves, the core halves clamped together axially with the largest diameter microspheres gripped between the axially opposing faces to provide the predetermined distance between the first ends of the first axially extending elements.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
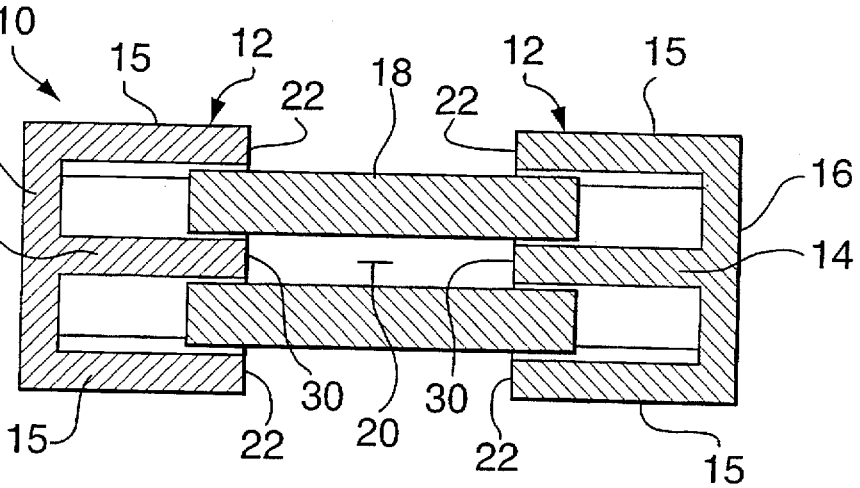
FIG. 1 is an exploded axial cross-sectional view of a magnetic device core according to a first embodiment.
Figure 2:
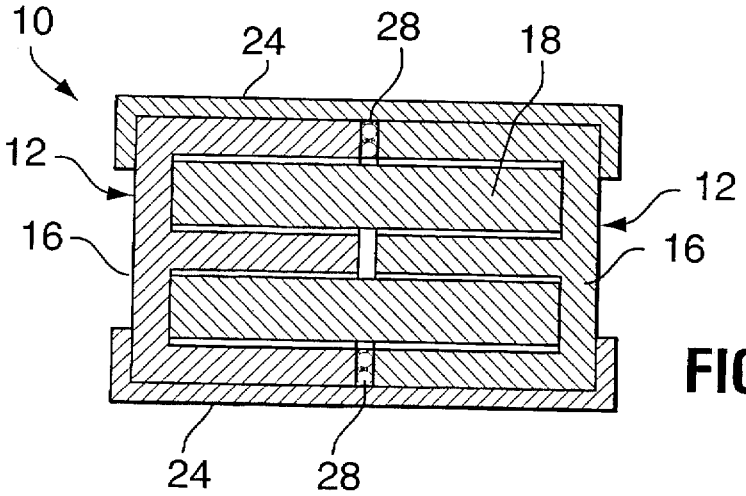
FIG. 2 is a view similar to FIG. 1 and showing the device core in assembled condition.

As shown in FIGS. 1 and 2, a miniature magnetic device core 10 of a first embodiment comprises two identical ferrite core halves 12. Each core half has a first axially extending element comprising a central axially extending shaft 14 and two outer diametrically opposed second axially extending elements or flange members 15 which are both coextensive axially with the central shaft 14 while being spaced radially from it. Each of the flange members 15 and the central shaft 14 extend outwardly from one side of a radially extending core end 16. In the finished construction as shown in FIG. 2, the two core halves are brought together axially one at each end of a wound magnetic coil 18 of conventional construction with the flange members of the core halves lying radially outwardly of the coil and with the central shafts 14 extending along a central axial passage 20 of the coil. An adhesive, to be described, is applied between opposing ends 22 of the flange members 15 and metal clamping members 24 are applied in diametrically opposite positions to clamp the two core halves axially towards each other onto the ends of the coil 18, the adhesive then setting to bond together the core halves.

Figure 3:
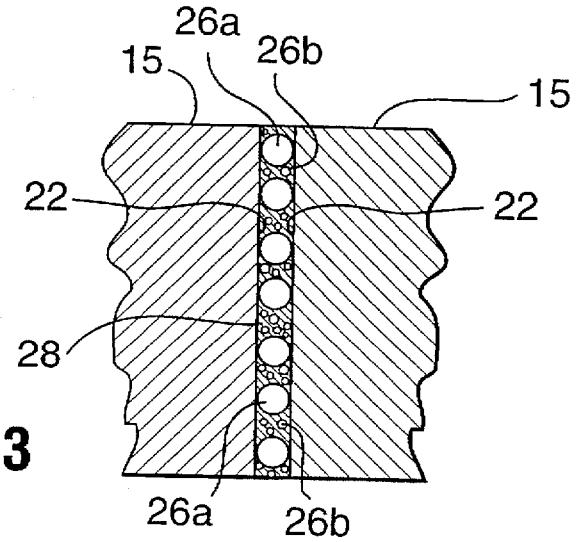
FIG. 3 is an enlarged view of part of the device core of FIG. 2 and showing the method of bonding together two halves of the core.

In this particular embodiment, the adhesive which is any adhesive suitable for the purpose, i.e. for bonding together the ferrite core halves, forms part of a mixture with glass microspheres 26 as shown in FIG. 3. The microspheres have a specific grid size whereby there are a certain percentage of the microspheres which have a maximum diameter which as may be realized is easily determinable by grid separation.

Thus, the maximum diameter microspheres 26a will contact the opposing end surfaces 22 when the clamps 24 are applied so that the end surfaces apply pressure diametrically across these microspheres. Other and smaller diameter microspheres, i.e. microspheres 26b, take no part in determining the distance between the surfaces 22 and merely remain in the mixture of adhesive 28 and the microspheres. Hence, it follows that in a mixture of microspheres and adhesive in which the grid separated microspheres occupy sufficient volume of the mixture, then the distance between the surfaces 22 may be accurately determined and is substantially equal to the diameter of the largest microspheres. It follows from this, as in the embodiment, that if the free end surfaces 30 of the central shaft are coplanar with the free end surfaces 22 of the flange members of the associated core halves, then the distance between the surfaces 30 in the finished assembly and across the air gap thus created, must equal the diameter of the largest microspheres in the mixture. As a result, the distance between the opposing end surfaces 30 may be easily determined in this situation by merely choosing the desired grid size of the glass microspheres.

Bearing the above thoughts in mind in this embodiment, the glass microsphere grid size is extremely small, if required, and realistically the distance between the end surfaces 30 may be as low as 3 mil or even lower. As a result of this, the magnetic device core of the embodiment may be of such minimal size that it is exceedingly below those normally producible by existing methods of manufacturing magnetic device cores in fact magnetic device cores according to the embodiment may be made sufficiently small to enable them to be mounted upon substrates such as printed circuit boards for incorporation into circuitry on such substrates. Production of such small magnetic device cores is simplified upon having each end surface 30 coplanar with the end surface of the flange member of the associated core half. By known manufacturing techniques, even upon extremely small core halves, such planar design is easily manufactured.

In addition, the invention avoids the use of normal spacer materials which may lead to displacement or creasing problems during assembly which place performance deviations on a completed core. Also, in the embodiment as shown, traditional grinding methods to produce surface ends 30 at different planar positions from the free end surfaces of the flange members is also avoided if the result wished to be achieved is having minimum magnetic device core size.

Figure 4:
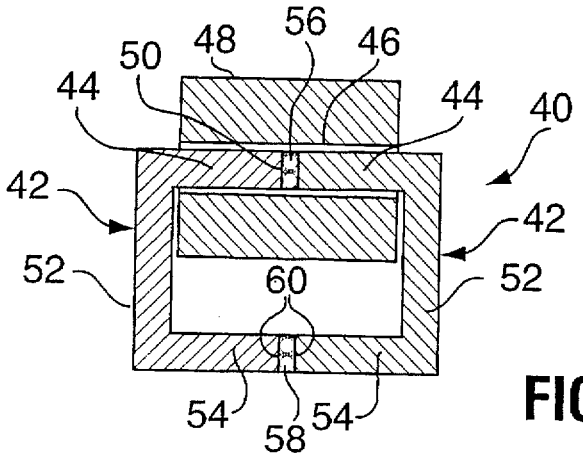
FIGS. 4 and 5 are views similar to FIG. 1 of cores of second and third embodiments.

In a second embodiment shown by FIG. 4, a miniature magnetic core device 40 comprises two identical ferrite core halves 42. Each core half has a first axially extending element or shaft 44 which is inserted into a central passage 46 of a wound magnetic coil 48 with an end 50 of the shaft 44 in opposition to and spaced from a comparable end 50 of the other core half. Each shaft 44 extends axially from a radially extending core end 52 at the opposite end of which is provided a single second axially extending member or leg 54. In the assembly as shown by FIG. 4, the legs 54 are in coaxial opposition.

Whereas in the first embodiment as shown in FIG. 2, no mixture of adhesive and microspheres was necessary in between the end surfaces 30 of the central shafts 14, in the second embodiment a mixture of the adhesive and microspheres is necessary between the opposing ends 50. This is because each core half is provided solely with the shaft 44 and the leg 54 and a mixture of the adhesive and microspheres is necessarily required both between the legs 54 and between the shafts 44 to build a rigid and stable core structure. Thus, in a method of assembling the device 42 as shown by FIG. 4, a mixture 56 of adhesive and microspheres is applied between the opposing ends 50 before the core halves are assembled onto the wound magnetic coil and also a further mixture 58 is required between opposing ends 60 of the legs 54. In this embodiment as with the first embodiment, the ends 50 and 60 may be machined so as to be coplanar and with the two mixtures 56 and 58 both having the same glass microsphere grid size in the mixture, then the distance between the ends 50 is exactly equal to the distance between the ends 60. However, if for some electrical performance reason it is desirable to have a slightly larger gap between the ends 50 as compared to the ends 60 or vice versa then one of the mixtures 56 and 58 may have a different glass microsphere grid size. With these grid sizes being only slightly different, e.g. in the order of about 1 mil, then this will inevitably result in neither the shafts 44 nor the legs 54 being exactly coaxial. However, this slight difference in spacing between the ends 50 as distinct from between the ends 60 does not in a practical sense create any problem in the structure or in its operation because the slight misalignment of the shafts 44 is negligible.

Figure 5:
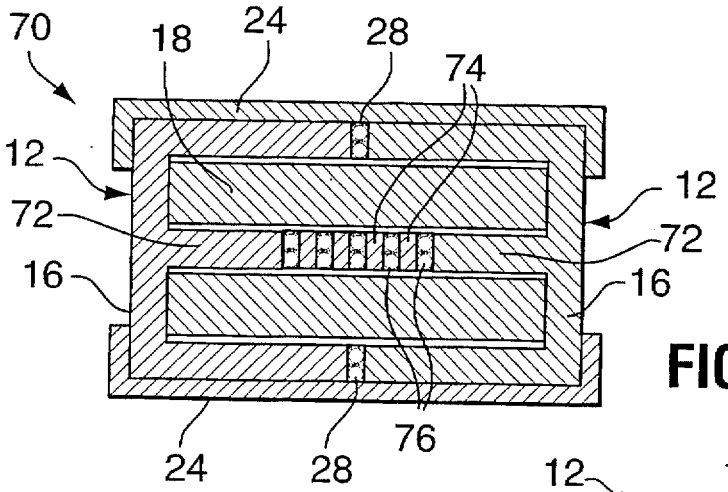

In a third embodiment as shown by FIG. 5, a magnetic device core 70 is basically similar to that of the first embodiment and like parts bear the same reference numerals. The device 70 differs however from the structure of the first embodiment in that the central shafts 14 of the first embodiment are replaced by axially shorter shafts 72 which, upon insertion within the wound magnetic coil 18, are spaced a substantial distance apart as shown by FIG. 5. With the structure of the third embodiment, to provide a particular electrical effect, the large space between the central shafts 72 is filled with a plurality of discs 74 of magnetic core material, the discs being in series axially along the gap. The discs are spaced apart by and alternate in their series with amounts of a mixture 76 of adhesive and glass microspheres of a desired grid size, end discs 74 of the series also being spaced from ends of the shafts 72 by this adhesive.

Figure 6:
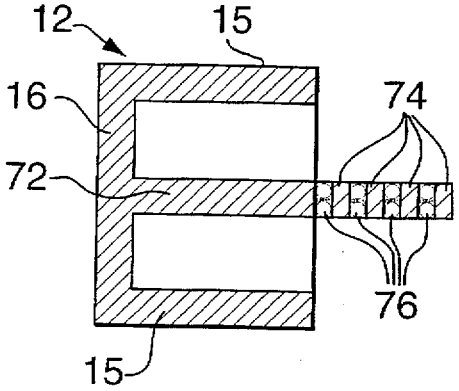
FIG. 6 is a cross-sectional view of part of the core of the third embodiment.

As shown by FIG. 6, before assembly of the device 70, the discs are either assembled axially onto one of the shafts 72 before insertion into the coil 18 or some of the discs are assembled onto each of the shafts in a modified method. As will be appreciated the distances between the discs and also between the end discs and the ends of the shafts 72 may be exactly and perfectly controlled by the glass microsphere size. The discs merely require locating in position with a slight clamping action to obtain the desired construction to provide the required electrical properties.

Figure 7:
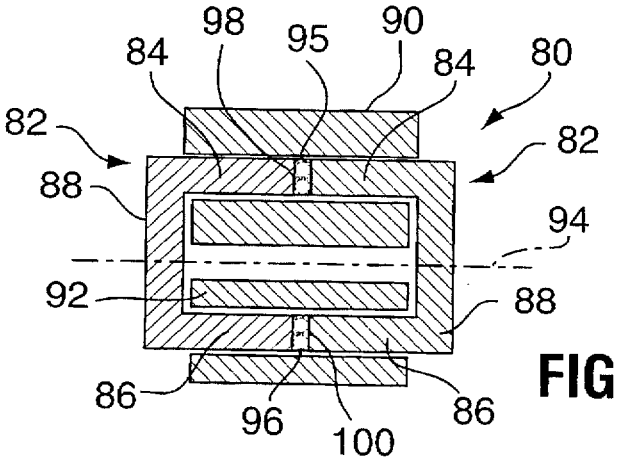
FIG. 7 is a view similar to FIG. 1 of a fourth embodiment.

In a fourth embodiment as shown by FIG. 7, a magnetic device core 80 comprises two core halves 82 each of which has a first axially extending element 84 and a second axially extending element 86 projecting from a radially extending core end 88. The first elements 84 provide shafts which axially oppose each other within a wound magnetic core 90 whereas the second axially extending elements 86 also provide shafts which oppose each other within a further wound magnetic core 92. In essence therefore the second axially extending elements 86 provide a similar function with regard to their magnetic core as do the elements 84 for the core 90. As will be appreciated with this structure which is centered around a centerline 94 of the core, mixtures 95 and 96 of the adhesive are provided between opposing ends 98 and 100 respectively of the elements 84 and 86 to form the assembly with the distances between the opposing ends controlled accordingly.

In a modification of the fourth embodiment (not shown), each core half may have more than two axially extending elements (i.e. in addition to the elements 84 and 86) with all of these elements spaced angularly apart around the centerline 94. With this modification, there is also an increase in the number of wound magnetic coils, i.e. the number of coils is equal to the number of axially extending elements of each core half. In the assembly, each core half extends axially through a central passage of a corresponding wound magnetic coil and has an end surface spaced a predetermined distance away from an opposing end surface of an associated axially extending element of the other core half. The distances between pairs of opposing faces is again controlled by a mixture of the adhesive and the glass microspheres and the grid size of the glass microspheres that are used in each of the mixtures.

What is claimed is:

1. A magnetic device core comprising:

a wound magnetic coil having a central axial passage;

two core halves each formed of a material having magnetic properties and each having a first axially extending element extending from a radially extending core of the associated core half to a first end of the element, and at least one second axially extending element radially outwards from and coextensive with the first axially extending element, the two core halves disposed with the radially extending core ends at opposite axial ends of the coil, the first axially extending elements extending towards each other along the passage to opposing free ends which are spaced apart by a predetermined distance, and the mixture of a set adhesive and non-compressible microspheres of a specific grid size disposed between axially opposing faces of the core halves, the core halves clamped together axially with the largest diameter microspheres gripped between axially opposing faces of the core halves to provide the predetermined distance between the first ends of the first axially extending elements.

2. A core according to claim 1 wherein each core half has at least two second axially extending elements with each second axially extending element of one core half axially aligned with an individual second axially extending element of the other core half.

3. A core according to claim 1 wherein the mixture is disposed between and secures together each second axially extending element and its associated and aligned second axially extending element of the other core half while an empty gap is formed with the predetermined distance between the first ends of the first axially extending elements.

4. A core according to claim 1 wherein the mixture of adhesive and non-compressible microspheres is disposed between and secures together each second element of a core half and its associated axially aligned second axially extending element of the other core half and a mixture of adhesive and microspheres of specific grid size is also disposed between and secures together the first ends of the first axially extending elements.

5. A core according to claim 1 wherein each core half has one second axially extending element only and an amount of a mixture of an adhesive and non-compressible microspheres of specific grid size is disposed between the second elements of the core halves and an amount of a mixture of adhesive and non-compressible microspheres of a specific grid size is disposed between the first ends of the first axially extending elements.

6. A core according to claim 1 including a further wound magnetic coil, the second axially extending elements of the core halves extending into opposite ends of the further coil, and a mixture of an adhesive and non-compressible microspheres of a specific grid size provides a predetermined distance between the second axially extending elements within the further coil.

7. A core according to claim 1 comprising an axial series of discs of magnetic core material located between the first ends of the first elements together with amounts of a mixture of adhesive and non-compressible microspheres of specific grid size, the discs alternating axially with the amounts of the mixture with spaces between the discs to maintain them axially apart and also from the first ends of the first axially extending elements.

8.A method of making a magnetic device core comprising:

providing two core halves each formed of a material having magnetic properties and each having a first axially extending element having a first end for insertion within a wound magnetic coil and having at a second end a radially extending core end, each core half also having a second axially extending element extending from its core end and radially spaced from the first axially extending element;

assembling together the core halves and a wound magnetic coil by inserting the first ends of the first axially extending elements into opposite ends of a central passage of the magnetic coil and with the second axially extending elements extending towards each other radially outside and coextensive with the coil;

and bringing the core halves axially together and clamping them together with a mixture of an adhesive and non-compressible microspheres of a specific grid size disposed between axially opposing faces of the core halves, the adhesive securing the core halves together with the largest microspheres determining the clamped distance apart of the opposing first ends of the first axially extending elements.

9. A method according to claim 8 comprising providing, in each core half the first end of the first axially extending element with an end surface which is coplanar with an end surface of the second axially extending element, and securing the core halves together with the distance apart of the end surfaces of the first axially extending elements being substantially equal to the distance apart of the end surfaces of the second axially extending elements and dictated by the largest diameter microspheres.

10. A method according to claim 8 wherein each core half has at least two second axially extending elements, the method comprising assembling the core halves with each second axially extending element of one core half axially aligned with an individual second axially extending element of the other core half.

11. A method according to claim 10 comprising applying an amount of mixture of adhesive and non-compressible microspheres of a specific grid size between the elements of each pair of axially aligned second axially extending elements and providing an empty gap having the predetermined distance between the first ends of the first axially extending elements.

12. A method according to claim 10 comprising applying an amount of a mixture of an adhesive and non-compressible microspheres of a specific grid size between the elements of each pair of axially aligned second axially extending elements and also between the first ends of the first axially extending elements.

13. A method according to claim 8 wherein each core half has one second element only, the method comprising applying an amount of mixture between the second elements and between the first ends of the first elements.

14. A method according to claim 8 comprising assembling together the core halves with the inclusion of a further wound magnetic coil, by passing the second axially extending elements into opposite ends of the further coil, a mixture of adhesive and non-compressible microspheres of a specific grid size being disposed between the second axially extending elements to provide a predetermined distance between the second axially extending elements within the further coil.

15. A method according to claim 8 comprising locating an axial series of discs of magnetic core material between the first ends of the first axially extending elements together with amounts of a mixture of adhesive and non-compressible microspheres of a specific grid size, the discs alternating axially with the amounts of the mixture so as to space the discs axially apart and also to space the discs apart from the first ends of the first elements.

* * * * *